US006225967B1

(12) United States Patent
Hebiguchi

(10) Patent No.: US 6,225,967 B1
(45) **Date of Patent: *May 1, 2001**

(54) MATRIX-DRIVEN DISPLAY APPARATUS AND A METHOD FOR DRIVING THE SAME

(75) Inventor: Hiroyuki Hebiguchi, Miyagi-ken (JP)

(73) Assignee: Alps Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/872,730

(22) Filed: Jun. 11, 1997

(30) Foreign Application Priority Data

Jun. 19, 1996 (JP) ..... 8-158649

(51) Int. Cl.[7] ..... G09G 3/36
(52) U.S. Cl. ..... 345/88; 345/83; 345/89
(58) Field of Search ..... 345/88, 89, 83, 345/211

(56) References Cited

U.S. PATENT DOCUMENTS 4,600,274 * 7/1986 Morozumi ..... 349/109
4,842,371 * 6/1989 Yasuda et al. ..... 345/96
5,151,689 * 9/1992 Kabuto et al. ..... 340/784
5,485,293 * 1/1996 Robinder ..... 359/59
5,619,225 * 4/1997 Hashimoto ..... 345/98
5,745,093 * 4/1998 Tsuzuki et al. ..... 345/103
5,748,165 * 5/1998 Kubota et al. ..... 345/96

FOREIGN PATENT DOCUMENTS 07199866 8/1995 (JP) .

* cited by examiner

*Primary Examiner*—William A. Cuchlinski, Jr.
*Assistant Examiner*—Marthe Y. Marc-Coleman
(74) *Attorney, Agent, or Firm*—Brinks Hofer Gilson & Lione

(57) ABSTRACT

Disclosed herein are a liquid-crystal display capable of reducing the required number of source drivers expensive and having large power consumption, which are used in the display, and providing a cost reduction and less power consumption of the display, and a method of driving the display.

In the display according to the present invention, pixels for displaying one color by utilizing a plurality of fundamental colors in combination are arranged in large numbers. The large number of pixels are matrix-driven by a large number of scanning lines and a large number of signal lines. Further, the combinations of the plurality of fundamental colors are repeatedly arranged along the directions of the respective signal lines. The number of the scanning lines is set to several times the number of the fundamental colors with respect to the total number of pixels arranged along the signal lines.

7 Claims, 9 Drawing Sheets

FIG. 3

| SCANNING LINE NO. \ SIGNAL LINE NO. | 1 | 2 | 3 |
|---|---|---|---|
| 1 | R | R | R |
| 2 | G | G | G |
| 3 | B | B | B |
| 4 | R | R | R |
| 5 | G | G | G |
| 6 | B | B | B |
| 7 | R | R | R |
| 8 | G | G | G |
| 9 | B | B | B |

FIG. 4

| SCANNING LINE NO. \ SIGNAL LINE NO. | 1 | 2 | 3 |
|---|---|---|---|
| 1 | R | B | G |
| 2 | G | R | B |
| 3 | B | G | R |
| 4 | R | B | G |
| 5 | G | R | B |
| 6 | B | G | R |
| 7 | R | B | G |
| 8 | G | R | B |
| 9 | B | G | R |

MATRIX-DRIVEN DISPLAY APPARATUS AND A METHOD FOR DRIVING THE SAME

BACKGROUND OF THE INVENTION

1. Field of the Invention

The present invention relates to a method and apparatus for displaying a color on a matrix driven display by utilizing a plurality of fundamental colors, e.g., R (red), G (green) and B (blue) in combination with one another.

2. Description of the Related Art

A conventional liquid-crystal display device which makes use of a display element, such as a liquid crystal or the like, in conjunction with a light source and color filters so as to allow a display of colors.

A thin-film transistor-driven liquid-crystal display will be described below as an example of a matrix driven display device. A pixel for displaying one color by utilizing three fundamental colors of R, G and B in combination as dots is formed as a color filter and arranged within a display region in large numbers. Signal lines and scanning lines are wired in matrix form to drive each of the liquid crystals. Pixel electrodes are respectively disposed in regions partitioned by the signal lines and the scanning lines. The pixel electrodes are operated by thin-film transistors by applying electric fields to the liquid crystals corresponding to the respective dots. The transmissivity of each liquid crystal is changed so as to select a display or a non-display mode.

In a display used for a computer to which this type of liquid-crystal display is applied, i.e., a VGA-standard display for performing a display of 640 (horizontal)×480 (vertical) dots, the number of pixels (each of which is formed by a set of respective one dots of R, G and B) used as display units is 640×480=307200. The pixels are represented in the form of a three-way RGB split RGB along the signal lines. Therefore, the number of the scanning lines and the number of the signal lines are 480 and 640×3=1920 respectively. Accordingly, the total number of dots is defined as 640×3×480=921600.

FIG. 9 shows a color liquid-crystal driven unit wherein a driving LSI is attached to the screen of this type of color liquid-crystal display. In the drawing, reference numeral 1 indicates a liquid-crystal element in which a liquid crystal is sealed between two transparent substrates, disposed in opposing relationship to one another. The first transparent substrate has common electrodes and color filters. The second transparent substrate has longitudinally-extending signal lines and transversely-extending scanning lines, wired in matrix form in large numbers. Pixel electrodes and thin-film transistors are respectively provided within the regions partitioned by the signal lines and the scanning lines. In the present example, a plurality of gate drivers Gd, for driving the scanning lines, are provided on the left side of the liquid-crystal element 1 and a plurality of source drivers Sd, for driving the signal lines, are respectively provided at the upper and lower sides thereof.

In the circuit of the present example, however, signal lines ($S_1$, $S_2$, $S_3$, . . . ) arranged in a vertical row, and the scanning lines ($G_1$, $G_2$, $G_3$, . . . ) arranged in a horizontal row, are formed in large numbers in an intersecting state. Furthermore, pixel electrodes 5 and thin-film transistors 6 are respectively provided within regions partitioned by the signal lines and the scanning lines. One region forming each pixel electrode 5 is defined as one dot and one pixel is constituted by a collection of three dots.

Thus, since a pixel 7 surrounded with the dot line shown in FIG. 10 is formed in the circuit shown in FIG. 9, 307200 pixels 7 are formed on one screen of the display of the VGA standards.

Since the source drivers Sd and gate drivers Gd attached to the liquid-crystal display element 1 having the number of the dots referred to above are normally constructed of a single LSI having about 240 output pins, ones mounted on the set of transparent substrates of the liquid-crystal element 1 are normally set to a TCP (Tape Carrier Package) configuration using a polyimide tape equipped with LSI or a COG (Chip-On Glass) configuration for directly mounting LSI on a substrate.

Thus, the number of the 240-pin source drivers Sd and the number of the 240-pin gate drivers GD needed to handle the 1920 signal lines and the 480 scanning lines, employed in the liquid-crystal display element 1, are eight (240×8=1920) and two (240×2=480) as shown in FIG. 9. Incidentally, an actual liquid-crystal display additionally needs circuits for supplying signals or the like to the drivers. However, the description of the circuits will be omitted herein.

The source drivers Sd are greater than the gate drivers Gd in power consumption:

(1) Driver power consumption is about 840 mW (2) Gate drivers: low—it is about 40 mW (20 mW×2) which accounts for 5% of the total power consumption; and (3) Source drivers: high—it is about 800 mW (100 mW×8) which accounts for 95% of the total power consumption.

It is also known that the normal unit price of the source drivers are about twice that of the gate drivers.

The power consumption of each source driver referred to above is typically one corresponding to 6 bits (64-step gradation) in a color display under the existing circumstances. When it is a 8-bit corresponding to one, both the price and power consumption become large values and the differences in cost and power consumption between the gate drivers and the source drivers tend to further increase.

It has been desirable to reduce the cost of a liquid crystal display device by reducing the required number of these expensive drivers. It has also been desirable to lessen the power consumption of the liquid-crystal display.

SUMMARY OF THE INVENTION

With the foregoing in view, it is therefore an object of the present invention to reduce power consumption of a driving circuit system employed in a display in which pixels for displaying one color, by utilizing a plurality of fundamental colors in combination, are arranged and matrix-driven.

According to one aspect of the present invention, for achieving the above object, there is provided a display comprising a plurality of pixels for displaying one color by utilizing a plurality of fundamental colors in combination, such that the pixels are arranged in large numbers. The large number of pixels are matrix-driven by a large number of scanning lines and a large number of signal lines. The combinations of the plurality of fundamental colors are repeatedly arranged along the directions of the respective signal lines, and the number of the scanning lines is set to several times the number of the fundamental colors with respect to the total number of pixels arranged along the signal lines.

Further, a structure having the aforementioned basic configuration or structure may be used wherein fundamental colors arranged along respective signal lines are repeatedly set to the same sequence along the signal lines and the same fundamental colors are arranged along scanning lines.

Moreover, a structure having the aforementioned basic structure may be used wherein fundamental colors arranged along signal lines are repeatedly set to the same sequence along the signal lines, the respective fundamental colors are arranged diagonally with respect to the signal lines, and the fundamental colors different from each other are arranged so as to adjoin along scanning lines.

According to another aspect of the present invention, there is provided a method of driving the display having the previously-described basic configuration, comprising a step of successively scanning all of scanning lines over one frame upon driving the display.

According to a further aspect of the present invention, there is provided a method of driving the display having the previously-described basic configuration, comprising the:

dividing one frame into a plurality of fields; and performing interlaced scanning of every predetermined field. The number of the predetermined files may preferably correspond to the number of the fundamental colors. When the number of the fundamental colors is three, for example, the number of the fields becomes three.

Furthermore, the device of the present invention provides a method for selecting either a method for successively scanning all of the scanning lines associated with one frame or a method for driving one frame into a plurality of fields and performing interlaced scanning for each of the fields.

The present invention has been briefly described. However, various embodiments of the present invention and the specific configurations thereof will be understood from the following description.

BRIEF DESCRIPTION OF THE DRAWINGS

While the specification concludes with claims particularly pointing out and distinctly claiming the subject matter which is regarded as the invention, it is believed that the invention, the objects, and features of the invention and further objects, features and advantages thereof will be better understood from the following description taken in connection with the accompanying drawings in which:

FIG. 3 is a view for describing one example of the layout of R, G and B of color filters in the structure shown in FIG. 2;

FIG. 4 is a view for describing another example of the layout of R, G and B thereof in the structure shown in FIG. 2;

DETAILED DESCRIPTION OF THE PREFERRED EMBODIMENTS

Preferred embodiments of the present invention will hereinafter be described with reference to the accompanying drawings.

Figure 1:
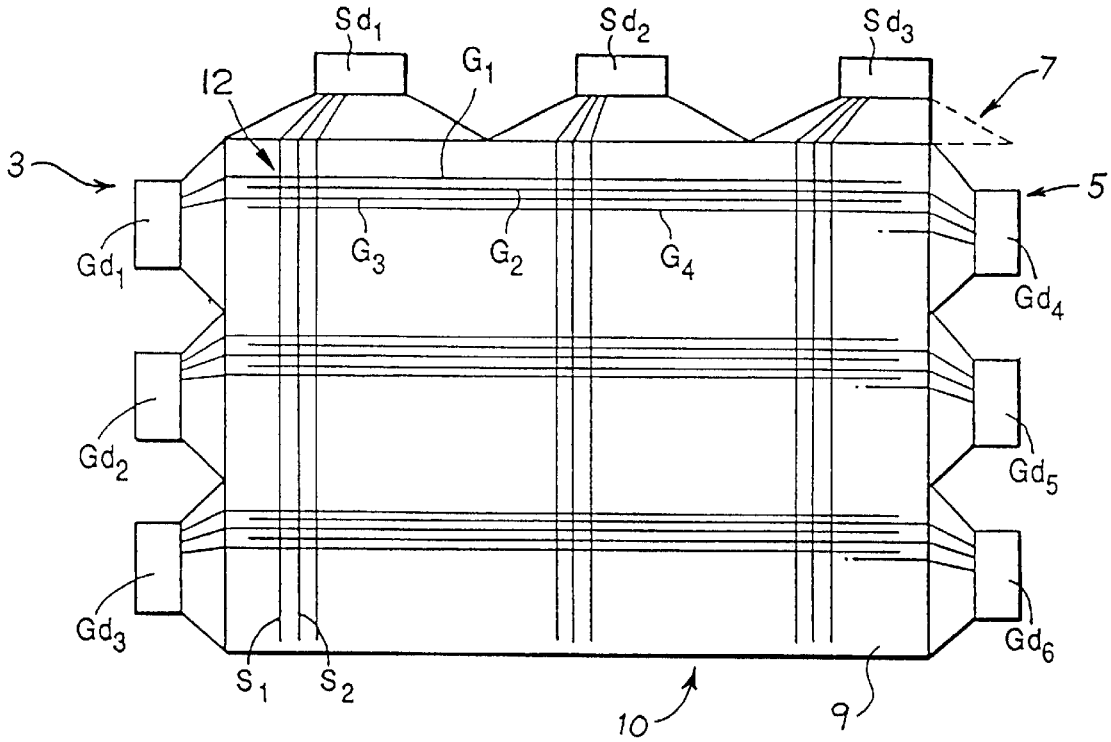
FIG. 1 is a plan view showing an embodiment of a display according to the present invention.

FIG. 1 shows an embodiment in which the present invention is applied to a thin-film transistor driven liquid-crystal display. In the present embodiment, liquid crystals are sealed between two transparent substrates 9 to form a liquid-crystal display element 10. Three source drivers Sd ($Sd_1$, $Sd_2$ and $Sd_3$) are provided at an upper edge 7 of the transparent substrates 9 used for the liquid-crystal display element 10. Six gate drivers Gd divided in two sets ($Gd_1$–$Gd_3$ and $Gd_4$–$Gd_6$) are positioned on a left side 3 and a right side 5 of the transparent substrates 9 of the liquid-crystal display element 10.

Next, common electrodes and color filters are provided on one of the two transparent substrates 9. Thin-film transistor circuits are formed on the other transparent substrate 9. A portion of its circuit configuration, which corresponds to a single pixel 12, of a plurality of pixels, is shown in FIG. 2, in enlarged form.

Figure 2:
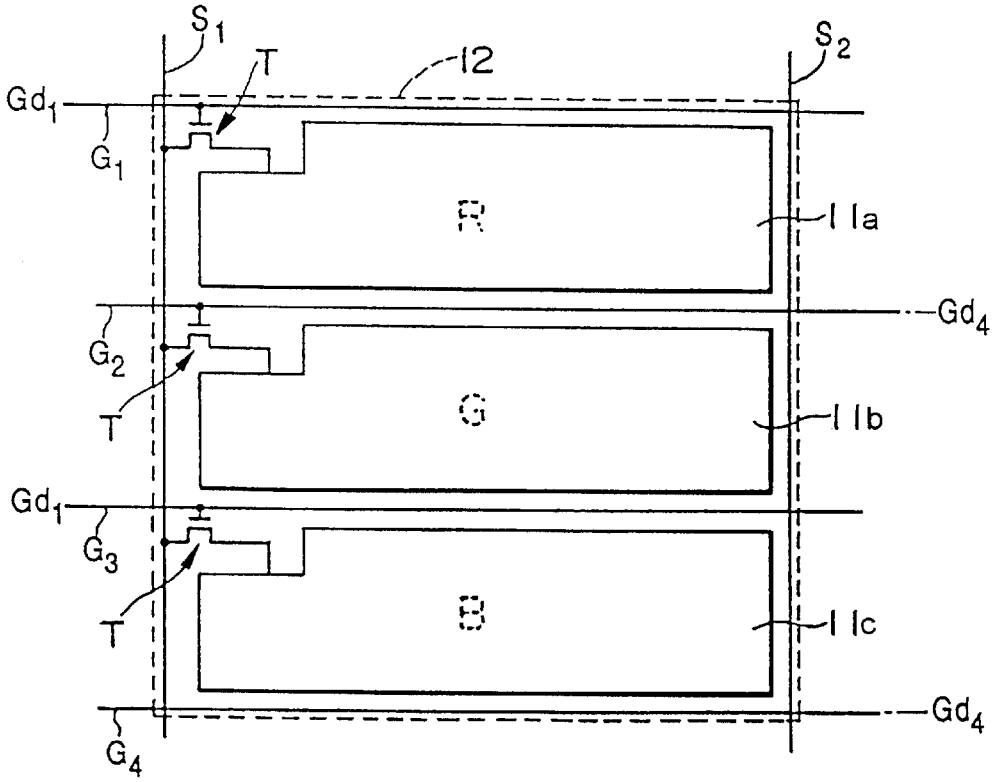
FIG. 2 is an enlarged view illustrating the relationship in structure between a pixel employed in the display shown in FIG. 1 and thin-film transistors.

The pixel 12, illustrated by FIG. 2, is formed by regions defined by two lengthwise-extending signal lines $S_1$ and $S_2$ and four transversely-extending scanning lines $G_1$, $G_2$, $G_3$ and $G_4$. An upper pixel electrode 11*a* is provided within the region defined by the signal lines $S_1$ and $S_2$ and the scanning lines $G_1$ and $G_2$. This region is defined as one dot. A middle pixel electrode 11*b* is provided within the region defined by the signal lines $S_1$ and $S_2$ and the scanning lines $G_2$ and $G_3$. This region is also defined as one dot. A lower pixel electrode 11*c* is provided within the region defined by the signal lines $S_1$ and $S_2$ and the scanning lines $G_3$ and $G_4$. This region is also defined as one dot. The pixel 12 is formed by the three pixel electrodes 11*a,* 11*b* and 11*c*. Furthermore, thin-film transistors T, used as switching elements, are connected to each of the pixel electrodes 11*a,* 11*b* and 11*c*.

Further, color filters are provided on the other substrate opposed to the transparent substrate with the pixel electrodes 11 formed thereon. In the present embodiment, as shown in FIG. 3, a R color filter, for example, can be placed in a position opposite to the upper pixel electrode 11*a,* a G color filer, for example, can be placed in a position opposite to the middle pixel electrode 11*b,* and a B color filter, for example, can be placed in a position opposite to the lower pixel electrode 11*c*. The layout of color filters R, G and B is shown in FIG. 3 inclusive of a plurality of other pixels. In the present embodiment, color filters are, as way of example, arranged in the order of RGB and RGB along the vertical directions of the individual signal lines. Color filters are respectively arranged in association with the number of scanning lines so as to extend in the order of R, R, R . . . , along the direction of a scanning line No. 1, G, G, G . . . , along the direction of a scanning line No. 2, B, B, B . . . , along the direction of a scanning line No. 3, R, R, R . . . , along the direction of a scanning line No. 4, G, G, G . . . , along the direction of a scanning line No. 5, and B, B, B . . . , along the direction of a scanning line No. 6 etc.

In the present embodiment, the number of signal lines S is 640, and the number of scanning lines G is 480×3=1440 in accordance with the VGA standards. Thus, in the present embodiment, the number of pixels is set to 640×480=307200, equal to the number of pixels employed in the conventional structure shown in FIG. 9. However, the number of signal lines is three times less than the number of signal lines employed in the conventional structure of FIG.

9. However, the number of scanning lines is three times greater than (several times the number of fundamental colors) the number of scanning lines employed in the conventional structure of FIG. 9.

A driving LSI having 240 pins, equal to those employed in the conventional example, can handle three source drivers Sd and 240×3=720 pins. Since the use of 640 pins in the VGA standards leaves an allowance of 80 pins, the three source drivers $Sd_1$ through $Sd_3$ are provided as shown in FIG. 1. In practice, all the terminals of two of the source drivers $Sd_1$ and $Sd_2$ about 160 terminals of the third source driver $Sd_3$ are electrically connected to their corresponding signal lines $S_1$, $S_2$ etc.

Since the required number of scanning lines is 1440, six gate drivers Gd are required for the LSI having 240 pins. Therefore, the six gate drivers $Gd_1$ through $Gd_6$ are provided as shown in FIG. 1. A description will be made of configurations of electrical connections between the gate driver $Gd_1$ and gate driver $Gd_4$ respectively located on the left and right upper sides of the set of transparent substrates and the scanning lines G, . . . . Each gate driver Gd is connected to 240 scanning lines, such that opposing gate drivers, for example $Gd_1$ and $Gd_4$, are coupled to 480 scanning lines. Each of the opposing pairs of gate drives, $Gd_1$–$Gd_4$, $Gd_2$–$Gd_5$, and $Gd_3$–$Gd_6$, is electrically connected to ever other scanning line. For example as illustrated in FIG. 1, $Gd_1$ may be connected to the odd numbered scanning lines $G_1$, $G_3$, etc., whereas its opposing counter part, $Gd_4$, is connected to the even numbered lines $G_2$, $G_4$, etc.

The source drivers Sd cost twice as much as the gate drivers Gd. Therefore, the price of the present invention can be significantly reduced because the number of source drivers is reduced from eight, used in the conventional apparatus, to three. The present invention comprises four more gate drivers Gd as does the conventional system (see FIG. 1 and FIG. 9). However, this is not a significant factor in the inflation of the overall cost, since gate drivers Gd cost about 50% less than source drivers Sd. Thus, the low cost due to the reduction in the number of the expensive source drivers can be achieved without significantly changing the number of display pixels.

The total power consumption is about 420 mW, i.e., six (6) gate drivers Gd each having a power consumption of 20 mW and three (3) source drivers Sd each having a power consumption of 100 mW. Therefore, the total power consumption of the present invention is one half the 840 mW total power consumption of the conventional device.

There has recently been proposed a structure in which thin-film transistor driving circuits are formed simultaneously when thin-film transistor circuits used as switching elements are formed on transparent substrates using polysilicon, and driving circuits are incorporated into a liquid-crystal transparent substrate. However, since source drivers Sd, which need to process a 6-bit to 8-bit multi-tonal signal at high speed, provide large power consumption as compared with 1-bit gate drivers Gd for on-off controlling liquid-crystal displaying pixel electrodes and the number of transistors for the source drivers Sd is great, a yield-reducing problem arises. Thus, a reduction in the number of signal lines and a reduction in the number of source drivers Sd greatly contribute to less power consumption and an improvement in yields even in the case of the liquid-crystal display having the driving circuits incorporated therein.

In the present embodiment, the color filters R, G and B have been arranged as shown in FIG. 3. However, the layout of the color filters R, G and B is not necessarily limited to the present embodiment. It is needless to say that such an arrangement or layout, e.g., R, B and G repeated along a scanning line No. 1, G, R and B repeated along a scanning line No. 2, B, G and R repeated along a scanning line No. 3, and R, B and G repeated along a scanning line No. 4, and so on, may be set so as to correspond to the number of repetitive scanning lines. This arrangement is one in which the order of fundamental colors arranged along the signal line Sd is set to the same order along each signal line repeatedly, the respective fundamental colors are respectively arranged diagonally with respect to the signal lines, and the fundamental colors different from one another are arranged so as to adjoint each other along the scanning lines.

Next, an advantageous effect can be expected in that although the layout of R, G and B in or by a pattern as shown in FIG. 3 is represented in the form of a layout that may be also referred to as a transverse stripe, signal processing is easy and the level or degree of consumption of a memory may be less because the adjacent signals are of the same fundamental color signals, when the signals are processed to process digital images on a personal computer, particularly when an error diffusion process for establishing correlation between the adjacent pixels is performed, if the layout of this configuration is used.

The layout of the patterns R, G and B shown in FIG. 4 may be also referred to as a mosaic layout. However, since no lateral stripe is produced when an image like a sight is displayed, the present embodiment can obtain a more natural and smoother image.

Next, a description of the method for driving the driving circuit, incorporated into the liquid-crystal display device of the present invention is given. A contrast to the conventional method will follow the description.

Figure 9:
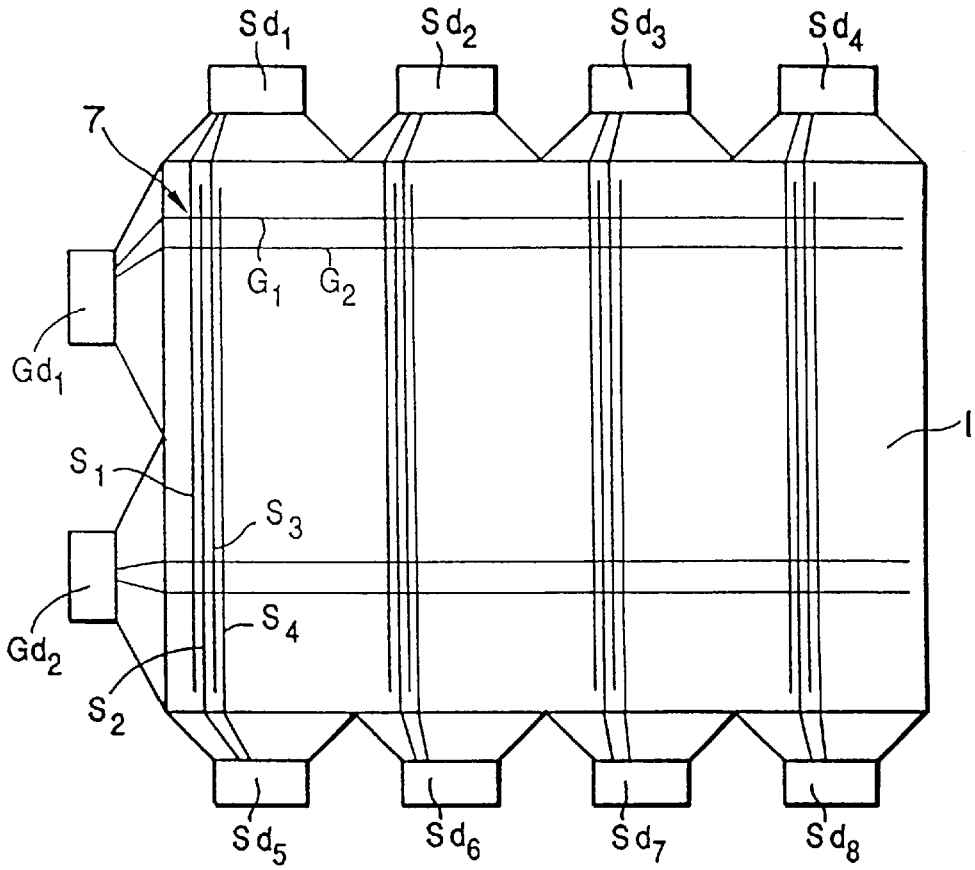
FIG. 9 PRIOR ART
FIG. 9 is a plan view showing a conventional liquid-crystal display.
Figure 10:
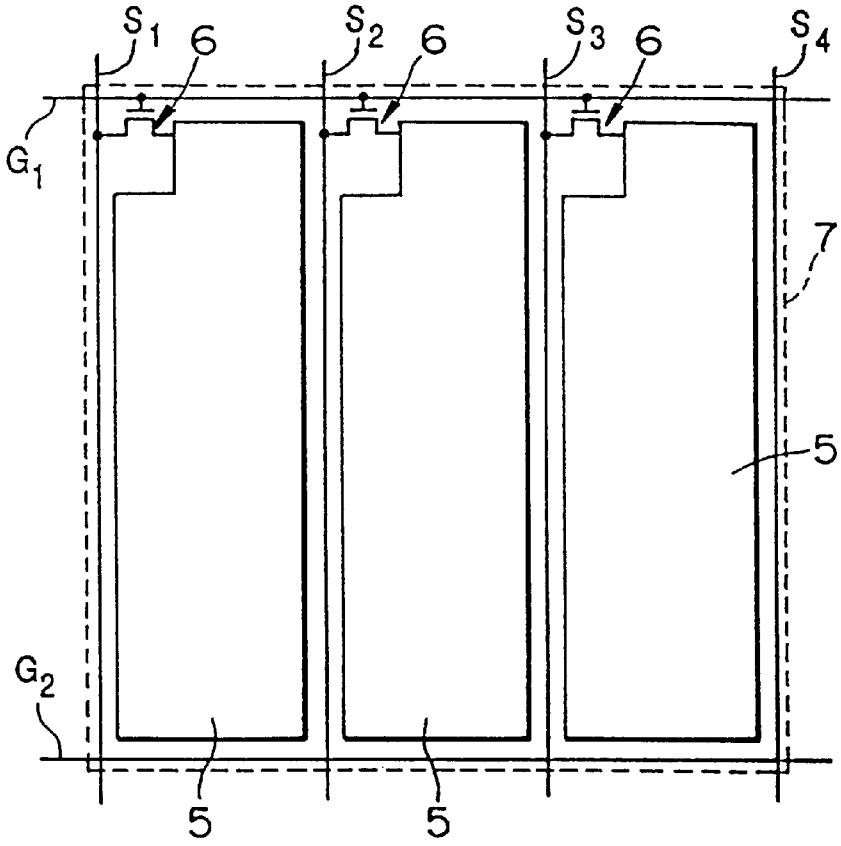
FIG. 10 PRIOR ART
FIG. 10 is an enlarged view of one pixel employed in the liquid-crystal display shown in FIG. 9.

A frame frequency is set to 60 Hz (i.e., the screen is rewritten or renewed 60 times for a second) when 640×480 dots are displayed on the conventional liquid-crystal display, as shown in FIGS. 9 and 10 in the VGA standards. Therefore, a time interval of about 16 msec. is required to renew one screen. Namely, 480 scanning lines are scanned for 16 msec. Thus, the frequency at which each of the gate drivers Gd scans scanning lines one by one is about 30 kHz (about 30 μsec. per scanning line) in the form of 60 Hz×480 scanning lines.

On the other hand, the source drivers Sd are supplied with signals corresponding to signal lines 640×3=1920 lines in time sequence on the signal line side. The source drivers Sd store them therein temporarily and are constructed so as to discharge the signals corresponding to the 1920 lines in union. Thus, a dot clock for reading the signals sent in time sequence one dot by one dot becomes about 60 MHz in the form of 30 kHz×1920 lines.

Figure 5:
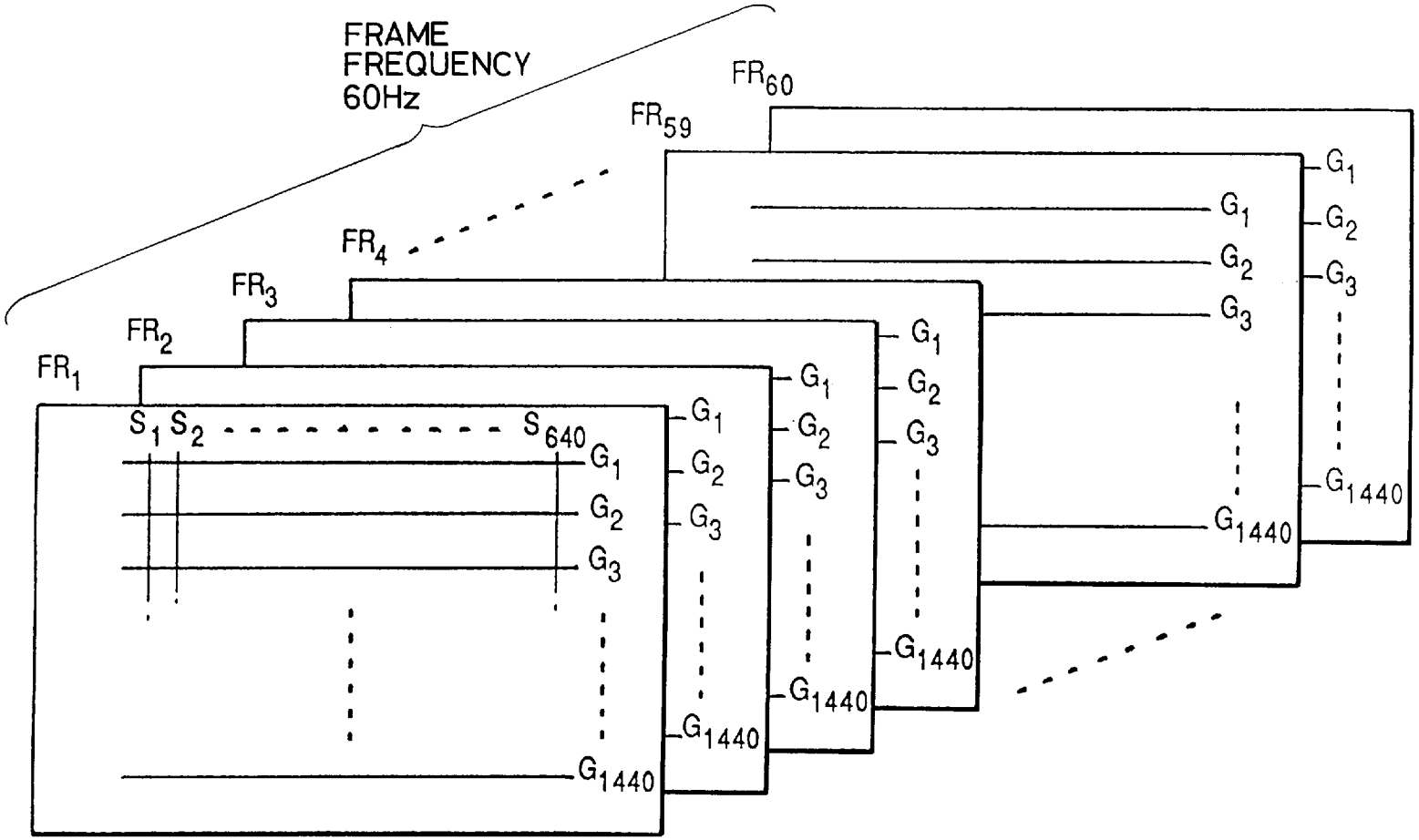
FIG. 5 is a view for describing one example of the relationship between a frame frequency and field used when the display according to the present invention is driven.

In contrast to this, since the number of scanning lines G is set to three times for R, G and B as shown in FIG. 5 as compared with the conventional structure shown in FIGS. 9 and 10, assuming that the frame frequency is set to 60 Hz in the same manner as described above using the liquid-crystal display having the structure shown in FIGS. 1 and 2, according to the embodiment of the present invention, the liquid-crystal display is driven with the scan speed as three times.

Specifically, since the number of the scanning lines G is set at 480×3=1440 and the number of signal lines S is set as 640, the frequency at which each of the gate drivers Gd scans each scanning line G, becomes about 90 kHz=60 Hz×480×3 lines. The normally-used gate drivers are operable till about 100 kHz. In terms of this point, the same gate drives as those employed in the conventional structure can be used.

On the other hand, since the number of the signal lines S can be set to 640 corresponding to ⅓ the number of the signal lines employed in the conventional structure shown in FIGS. 9 and 10 in the case of the structure shown in FIGS. 1 and 2, a dot clock for each source driver Sd becomes about 60 MHz=90 kHz×640 lines. Therefore, the present structure remains the same as the conventional structure.

Thus, if the structure shown in FIGS. 1 and 2 is used, the same gate drivers Gd and source drivers Sd as those employed in the conventional structure shown in FIGS. 9 and 10 can be used.

The structure shown in FIGS. 1 and 2, according to the one embodiment of the present invention can bring about the following advantageous effects:

(1) The structure shown in FIGS. 1 and 2 causes no picture degradation as compared with the liquid-crystal display having the conventional structure shown in FIGS. 9 and 10.

Namely, when one screen is spatially viewed, the number of pixels reaches 307200 and no change in resolution occurs even in the case of the structure shown in FIG. 1 and the structure shown in FIG. 9. Since the frame frequency is 60 Hz in terms of the time even in the case of the structure shown in FIG. 1 and the structure shown in FIG. 9, no problem is offered even from the viewpoint of motion representation.

(2) The present invention, as illustrated in FIG. 1, uses the same type of gate drivers Gd and source drivers Sd as that of the conventional structure, illustrated in FIG. 9. Even though the number of inexpensive gate drivers Gd is increased by three, as compared to the conventional liquid-crystal display, the number of source drivers Sd, which cost twice as much as the gate drivers Gd, is reduced from eight to three. As a result, the overall cost of the device is reduced.

(3) Power consumption can be reduced.

The driver power consumption for the gate drivers Gd in the conventional device is 120 mW because each of the six gate drivers Gd have a power consumption of 20 mW. However, the power consumption per gate driver Gd in the present invention is three times greater than the conventional device since the frequency used to scan each scanning line is three times higher. Therefore, the power consumption for the gate drivers Gd of the present invention is 360 mW. On the other hand, the power consumption for the source drivers Sd is 300 mW because each of the three source drivers Sd have a power consumption of 100 mW. As a result, the total power consumption of the gate drivers Gd and the source drivers Sd is 660 mW. The conventional device as a total power consumption of 840 mW (i.e., 8 Sds having power consumption of 100 mW each and 2 Gds having a power consumption of 20 mW each). Therefore, the total power consumption of the present invention, 660 mW, is 180 mW less than that of the conventional device's total power consumption of 840 mW.

Another embodiment of the driving method using the structure shown in FIGS. 1 and 2 will be described below with reference to FIG. 6.

Figure 6:
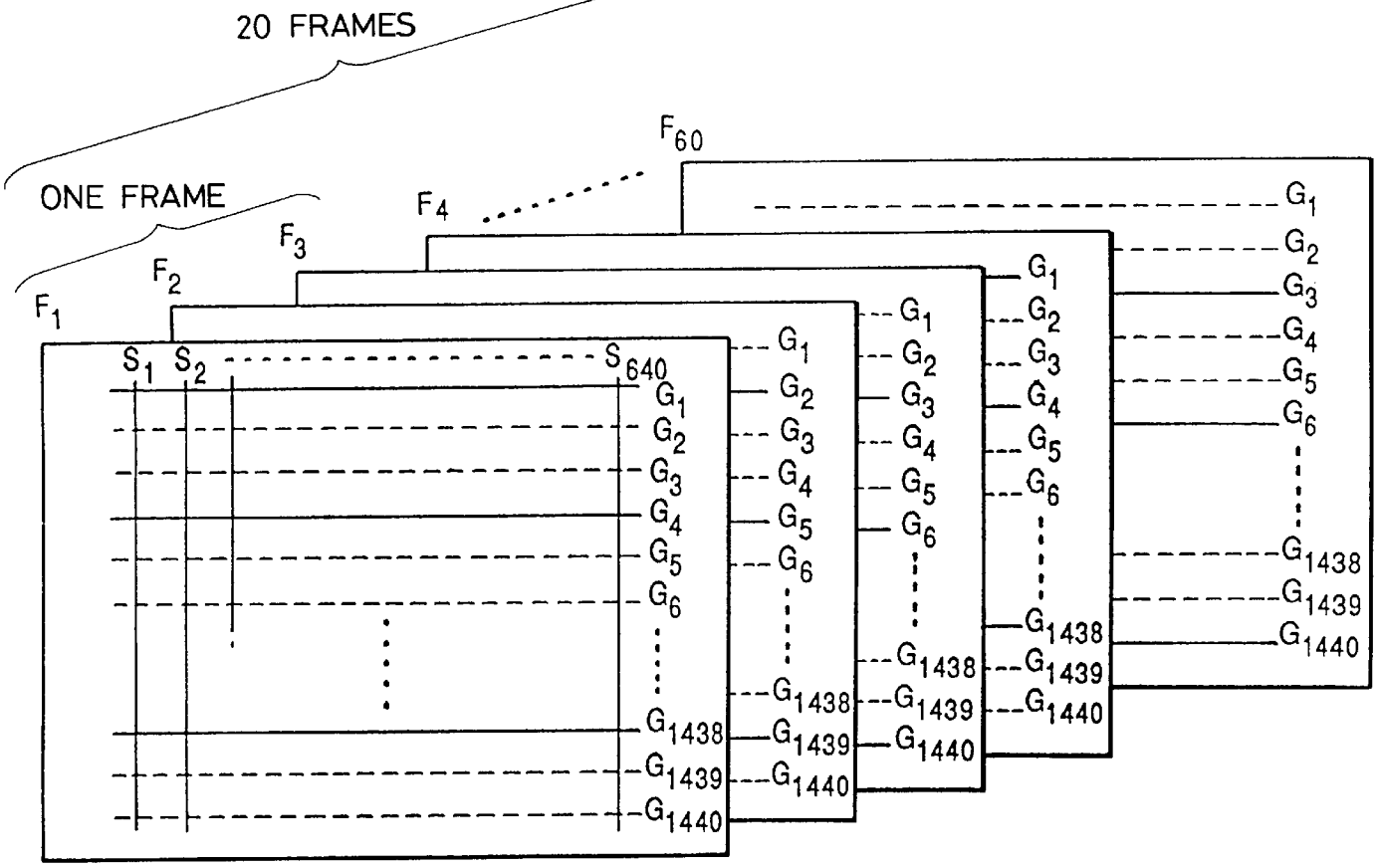
FIG. 6 is a view for describing another example of the relationship between the frame frequency and the fields used when the display according to the present invention is driven.

The driving method according to the present embodiment has a characteristic in that one frame is divided into three fields as shown in FIG. 6 and interlaced scanning, with two lines interlaced between the fields, is performed.

Described specifically, one screen is written at three field intervals, a frame frequency is set to 20 Hz, a field frequency is set to 60 Hz (about 16 msec.) and the number of scanning lines to scan during one field (about 16 msec.) is set to 480, corresponding to ⅓ of the total number of scanning lines. Accordingly, the frequency at which each of gate drivers Gd scans each scanning line, becomes 60 Hz×480 scanning lines. Therefore, the frequency reaches about 30 kHz, same as when the liquid-crystal display having the conventional structure shown in FIGS. 9 and 10 is driven. As a result, the frequency can be set to one third the frequency at the driving method according to the previously-described embodiment of the present invention. Correspondingly, a dot clock also becomes 30 kHz×640 scanning lines and hence reaches about 30 kHz, same as when the liquid-crystal display having the conventional structure shown in FIGS. 9 and 10 is driven, i.e., one third of that which is employed in the previous embodiment of the present invention.

When the above-described driving method is adopted, the following advantageous effects can be obtained:

(1) Gate drivers Gd and source drivers Sd similar to those employed in the conventional structure shown in FIGS. 9 and 10 can be used. Although the number of inexpensive gate drivers needs to increase from 2 to 6, the number of expensive source drivers can be reduced from 8 to 3. Therefore, a cost reduction can be achieved.

(2) The driver power consumption is 120 mW because each of the six gate drivers Gd have a power consumption of 20 mW. In the present invention, three source drivers Sd are used, each having a power consumption of about 100 mW. However, the number of their dot clocks is one third of that of the conventional device. Therefore, the power consumption per source driver Sd is reduced by one third, i.e., the power consumption per source driver Sd is 100/3 mW. As a result a total power consumption of 200 mW is required (i.e., 120 mW for the gate drivers Gd and 100 mW for the source drivers Sd). The power consumption is one fourth of the 840 mW power consumption of the conventional device.

(3) The present structure can be implemented by decreasing the number of circuit portions to be used in the design (the conventional structure rather than the previous embodiment can be applied). Particularly when one frame is divided into fields corresponding to the number of fundamental colors (three fields of R, G and B in the present embodiment), a field frequency is set to 60 Hz and interlaced scanning is performed with two lines interlaced between the fields. The frequency for scanning each scanning line for each gate driver can be set to about 30 kHz with 60 Hz×480 lines just the same as ever, and peripheral circuits of the gate drivers can be configured in the same manner as those employed in the conventional structure.

The above-described embodiments have described the liquid-crystal display (TFT-LCT) using the thin-film transistors, as a base. However, the display wherein pixels for displaying one color by a combination of a plurality of fundamental colors (e.g., R, G and B) are arranged and matrix-driven, can expect the same effect as described above. It is therefore needless to say that the present invention can be widely applied to a simple matrix liquid-crystal display, an FED (Field Emission Display), a ferro-electric liquid-crystal display, a plasma display, an EL display, etc. Since one pixel can be divided into, for example, two colors or four colors when it is divided into the number of fundamental colors, the number of scanning lines is set to twice or four times the number of scanning lines employed in the prior art when such color divisions are performed. As the layout of color filters, the two or four colors may be also set to the aforementioned transverse stripe layout or mosaic layout.

Figure 7:
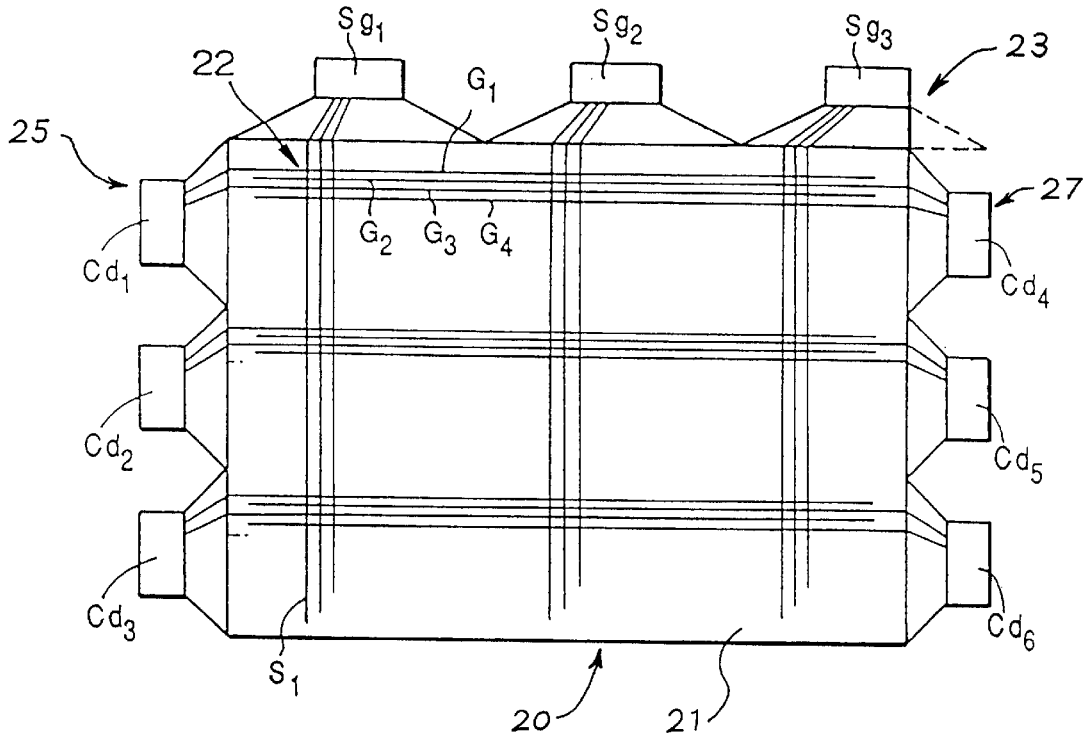
FIG. 7 is a view showing an embodiment in which the present invention is applied to a simple matrix-driven liquid-crystal display.
Figure 8:
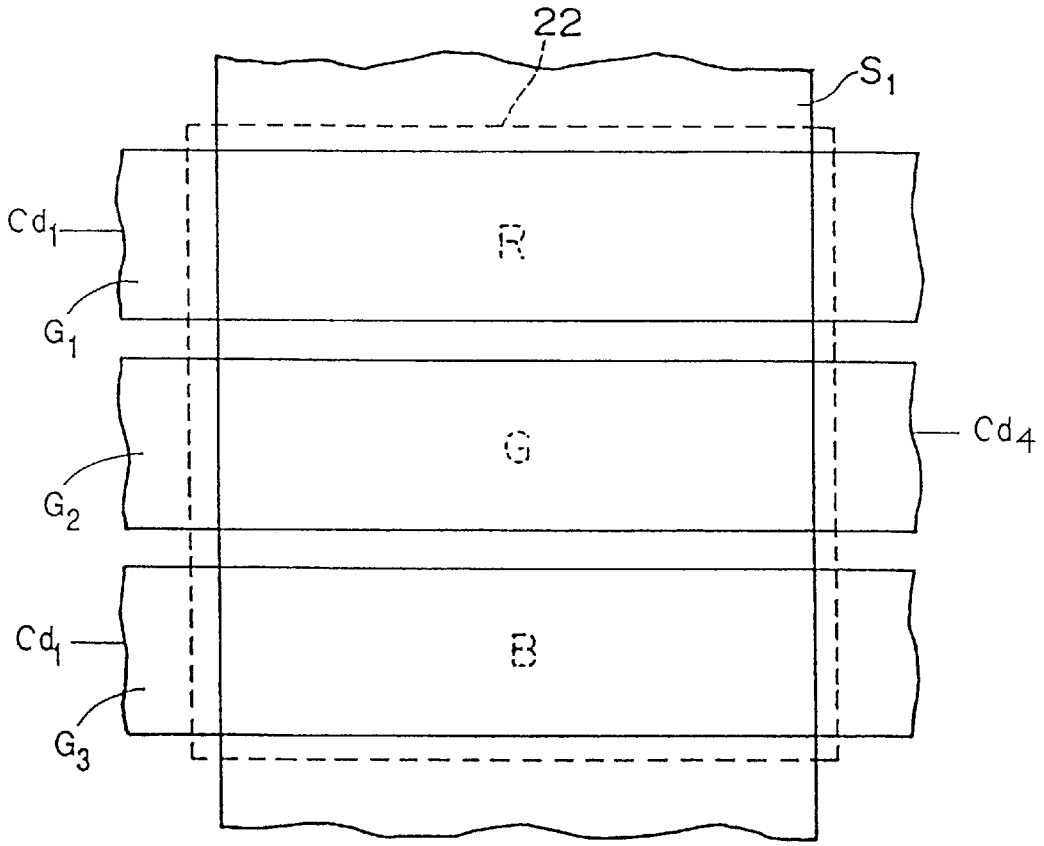
FIG. 8 is an enlarged view of one pixel employed in the liquid-crystal display shown in FIG. 7.

FIGS. 7 and 8 shown an embodiment in which the present invention is applied to a simple matrix type liquid-crystal display. In the present embodiment, a liquid-crystal element 20 is constructed wherein liquid crystals are sealed between two transparent substrates. Color filter are disposed on the liquid crystal side of one of the transparent substrates 21. Scanning lines ($G_1$, $G_2$, . . . $G_n$) and signal lines (S1, S2, . . . $S_n$), both comprising transparent conductive layers, are selectively disposed on the transparent substrate side and the liquid crystal side of the transparent substrates 21, such that the scanning lines G are perpendicular the signal lines S. FIG. 8 illustrates, in an enlarged form, pixel 22 of FIG. 7. Even in this case, a color filter is divided into three fundamental colors of R, G and B. Scanning lines $G_1$, $G_2$ and $G_3$ define the regions of the fundamental colors R, G, and B.

Further, segment drivers $Sg_1$, $Sg_2$ and $Sg_3$ are provided at upper edges 23 of the transparent substrates 21. Terminals of the segment drivers Sg are electrically connected to their corresponding signal lines S. A pairs of three common drivers (Cd1–Cd3 and Cd4–Cd6) are disposed on a left edge 25 and a right edge 27 of the transparent substrates 42, respectively. Terminals of the drivers are electrically connected to their corresponding scanning lines G.

Similar to the embodiment described above, gate lines G are connected to the common drivers Cd in an alternating formation. By way of example only, odd numbered gate drivers $G_1$, $G_3$, etc. may be connected to $Cd_1$ while even numbered gate drivers $G_2$, $G_4$, etc. may be connected to $Cd_1$'s opposing counter part—Cd4. This same principle applies to the other pair of gate drivers $Cd_2$–$Cd_5$ and $Cd_3$–$Cd_6$.

The present embodiment achieves an object by constructing each pixel in a region interposed and partitioned by the signal lines S and the three scanning lines G and dividing the pixel into three dots.

In the simple matrix type liquid-crystal display as described above, an electric field is applied to the liquid crystal existing between the intersecting portions of the opposing signal lines S and scanning lines G to drive the liquid crystals. Therefore, the portion where the signal line S and the scanning line G intersect, constitutes one dot.

The aforementioned respective embodiments have described the 640×480 pixels defined in the VGA standards. However, various screen display forms are known in addition to this. It is needless to say that the structure of the present invention can be applied according to various standards such as a television screen of the 480-line NTSC system, a television screen of the 570-line PAL system, the 1125-line HDTV system, the 600-line SVGA, the 768-line XGA, the 1024-line EWS, etc.

Furthermore, the driving method embodiment with reference to FIG. 5 and the driving method embodiment with reference to FIG. 6 can selectively be chosen. When the liquid-crystal display is used for a notebook personal computer, for example, it may be configured so that a selector switch is provided around a display of the notebook personal computer so as to perform switching between a driver circuit for executing the driving method described with reference to FIG. 5 and a driver circuit for performing the driving method described with reference to FIG. 6, thereby making it possible to change a displayed state of the display according to use purposes.

According to the present invention, as has been described above, no picture degradation is produced as compared with a liquid-crystal display having a conventional structure and the same gate and source drivers as those employed in the liquid-crystal display having the conventional structure can be used. Further, expensive source drivers can be greatly reduced in number. The number of gate drivers Gd used in the preset invention is greater than the number used in the conventional system. On the other hand, the number of source drivers Sd of the present invention is less than that of the conventional system. Because source drivers Sd are more expensive than gate drivers Gd, the overall cost of the preset invention is lower than that of the convention system.

When three fundamental colors, for example, define a single pixel, the number of scanning lines and the number of gate drivers Gd is three times greater than that of the conventional device. On the other hand, the number of signal lines and the number of source drivers Sd is three times less than that of the conventional device.

The power consumption of the present invention is less than that of the conventional system. The power consumption is less because the number of source drivers Sd, which consume considerably more power than gate drivers Gd, is reduced. The increase in the number of gate drivers Gd does not significantly bolster the amount of power consumption.

On the other hand, the display having the previously-described structure can be driven by dividing one frame into a plurality of fields and performing line scanning on every field. By dividing one frame into a plurality of fields and performing interlaced scanning on every predetermined field, the frequency to scan each scanning line can be set to the same extent as when the display having the conventional structure is driven, regardless of an increase in the number of the scanning lines. Therefore, power consumption per source driver can be further reduced so as to provide power savings.

Further, a display can be provided which is capable of selecting a driving method according to various display forms by adopting a structure capable of switching between driver circuits for executing these driving methods in the display.

Having now fully described the invention, it will be apparent to those skilled in the art that many changes and modifications can be made without departing from the spirit or scope of the invention as set forth herein.

What is claimed is:

1. A display comprising:

a plurality of pixels arranged in a matrix, each pixel containing a set of three dots, each of said three dots having any one fundamental color among three fundamental colors respectively being red, green and blue, the plurality of pixels operative to display one color by utilizing said three fundamental colors in combination;

a plurality of scanning lines, each scanning line defining a row of the matrix and being separated by a dot; and a plurality of signal lines, each signal line defining a column of the matrix, each pixel being driven by a signal line and three scanning lines and each dot being driven by a scanning line and a signal line;

wherein the pixels are arranged along the signal lines such that the set of three dots contained in the pixels disposed along each signal line are repeated in each pixel in a set order and the dots disposed along each scanning line are repeated in a predetermined order; and the number of the scanning lines is set to the number of pixels arranged along the signal lines multiplied by the number of fundamental colors, the number of dots arranged along each signal line is set to the multiplied number, and the number of dots arranged along each scanning line is set to be equal to the number of pixels arranged along each scanning line.

2. A display according to claim 1, wherein the three fundamental colors respectively being red, green and blue, arranged along the signal lines, are repeatedly set to the same sequence along the signal lines and the same fundamental colors are arranged along the scanning lines.

3. A display according to claim 1, wherein the three fundamental colors respectively being red, green and blue, arranged along the signal lines, are repeatedly set to the same sequence along the signal lines, the same fundamental colors are respectively arranged diagonally with respect to the signal lines, and fundamental colors different from each others are arranged to adjoint along the scanning lines.

4. A display having the structure according to claim 1 further comprising a scanning mechanism to successively scan all of scanning lines over one frame upon driving said display.

5. A display having the structure according to claim 4 further comprising:

a dividing mechanism to divide one frame into a plurality of fields, and to perform interlaced scanning for each of the plurality of fields; and a switching mechanism to change between said scanning mechanism and said dividing mechanism.

6. A display having the structure according to claim 1 further comprising a dividing mechanism to divide one frame into a plurality of fields, and to perform interlaced scanning for each of the plurality of fields.

7. A display having the structure according to claim 1 further comprising:

a dividing mechanism to divide one frame into a plurality of fields, and to perform interlaced scanning for each of the plurality of fields; and a scanning mechanism to successively scan all of scanning lines associated with one frame; and a switching mechanism to change between said said dividing mechanism and scanning mechanism.

* * * * *

UNITED STATES PATENT AND TRADEMARK OFFICE

CERTIFICATE OF CORRECTION

PATENT NO. : 6,225,967 B1
DATED : May 1, 2001
INVENTOR(S) : Hiroyuki Hebiguchi

It is certified that error appears in the above-identified patent and that said Letters Patent is hereby corrected as shown below:

Title page,
Item [73], immediately after "(JP)" insert -- ; LG Philips LCD Co. Ltd., Seoul (Korea) --.

Claim 3,
Line 7, change "adjoint" to -- adjoin --.

Claim 7,
Line 8, change "between said said" to -- between said --.

Signed and Sealed this

Ninth Day of April, 2002

*Attest:*

*Attesting Officer*

JAMES E. ROGAN
*Director of the United States Patent and Trademark Office*